US007191771B2

(12) United States Patent
Ketterer et al.

(10) Patent No.: US 7,191,771 B2
(45) Date of Patent: Mar. 20, 2007

(54) METHOD FOR CONTROLLING AN INTERNAL COMBUSTION ENGINE HAVING A LAMBDA REGULATION

(75) Inventors: Alexander Ketterer, Pettendorf/Adlersberg (DE); Hong Zhang, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/545,040

(22) PCT Filed: Jan. 15, 2004

(86) PCT No.: PCT/EP2004/000269

§ 371 (c)(1),
(2), (4) Date: Aug. 11, 2005

(87) PCT Pub. No.: WO2004/074663

PCT Pub. Date: Sep. 2, 2004

(65) Prior Publication Data

US 2006/0137667 A1 Jun. 29, 2006

(30) Foreign Application Priority Data

Feb. 19, 2003 (DE) ..... 103 07 004

(51) Int. Cl.
*F02D 41/14* (2006.01)

(52) U.S. Cl. ..... 123/674; 123/680; 123/686

(58) Field of Classification Search ..... 123/674, 123/675, 680, 681, 685, 686, 689; 701/109
See application file for complete search history.

(56) References Cited

U.S. PATENT DOCUMENTS

| | | | | |
|---|---|---|---|---|
| 4,964,271 | A | 10/1990 | Sawada et al. | |
| 5,220,904 | A | 6/1993 | Miyashita et al. | |
| 5,279,275 | A * | 1/1994 | Freudenberg | 123/686 |
| 5,546,918 | A | 8/1996 | Mayer et al. | |
| 5,564,406 | A | 10/1996 | Klein | |
| 5,743,244 | A | 4/1998 | Bush et al. | |
| 5,794,604 | A | 8/1998 | Suzuki et al. | |
| 6,766,790 | B2 * | 7/2004 | Grass et al. | 123/491 |

FOREIGN PATENT DOCUMENTS

| | | |
|---|---|---|
| DE | 42 36 008 A1 | 4/1994 |
| DE | 44 23 241 A1 | 1/1995 |
| DE | 195 01 458 A1 | 7/1996 |
| DE | 199 55 252 A1 | 6/2001 |
| EP | 0 710 771 A2 | 5/1996 |

* cited by examiner

*Primary Examiner*—T. M. Argenbright

(57) ABSTRACT

The aim of the inventive method is to improve the emission values of an internal combustion engine during idling following a cold start. Said aim is achieved by inferring an adaptive value for the required fuel quantity from a characteristic curve in accordance with the temperature of the internal combustion engine and verifying during continuous lambda regulation whether predetermined adaptation conditions are met. If so, an adaptive value is determined from the parameters of the lambda regulator and the characteristic curve is adjusted according the newly determined adaptive value and the measured temperature of the internal combustion engine.

9 Claims, 1 Drawing Sheet

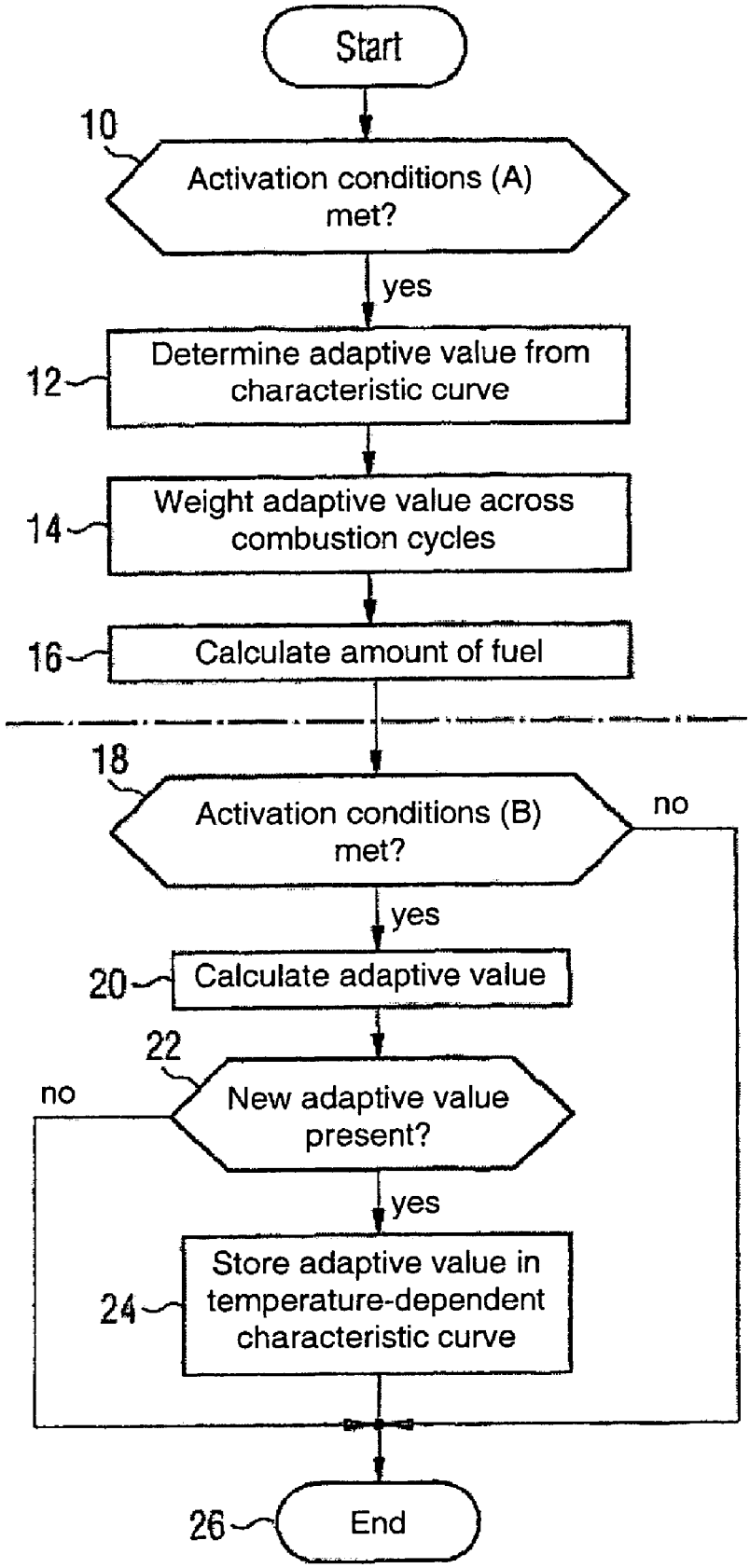
Start
10
Activation conditions (A) met?
yes
12
Determine adaptive value from characteristic curve
14
Weight adaptive value across combustion cycles
16
Calculate amount of fuel
18
Activation conditions (B) met?
no
yes
20
Calculate adaptive value
22
New adaptive value present?
no
yes
24
Store adaptive value in temperature-dependent characteristic curve
26
End

METHOD FOR CONTROLLING AN INTERNAL COMBUSTION ENGINE HAVING A LAMBDA REGULATION

CROSS REFERENCE TO RELATED APPLICATIONS

This application is the U.S. National Stage of International Application No. PCT/EP2004/000269, filed Jan. 15, 2004 and claims the benefit thereof. The International Application claims the benefits of the German application No. 10307004.4, filed Feb. 19, 2003. The International Application and the German application are incorporated by reference herein in their entirety.

FIELD OF INVENTION

The present invention relates to a method for controlling an internal combustion engine having a lambda control.

BACKGROUND OF THE INVENTION

Internal combustion engines are subject to deviations in pilot mixture controlling due to the interaction of tolerances specific to individual system components such as, for example, injection valves, load sensors, etc. When mixture controlling has been activated by the lambda control and through mixture controlling while the internal combustion engine is at its operating temperature, the system tolerance will be minimized and subsequently contribute only slightly to the internal combustion engine's emission characteristics. Only immediately after the internal combustion engine starts do the system tolerances have a direct impact on its emission characteristics.

SUMMARY OF THE INVENTION

The only possible way to date to ensure effective pilot mixture controlling prior to the application of lambda controlling has been to restrict the tolerances for the system components depending on their contribution to the emission characteristics. What is disadvantageous therein is that very great accuracies in production have to be specified which significantly increase the costs.

An object of the invention is to provide a method for controlling an internal combustion engine having a lambda control which method will reduce the emission of exhaust gas by simple means prior to the application of lambda controlling.

Said object is achieved by the claims.

With the method according to the invention a check is carried out in a first phase after the internal combustion engine starts in order to determine whether predefined activation conditions exist. If they do, an adaptive value will be determined for the internal combustion engine for determining the fuel mixture as a function of the measured temperature via a characteristic curve. The method is based on the knowledge that pilot mixture controlling leads to deviations of varying intensity in the combustion lambda, depending on the internal combustion engine's starting temperature, and hence to poorer emission values than in a reference system. An adaptive value that takes account of the internal combustion engine's temperature on starting is used in the method according to the invention for determining the fuel mixture. The activation conditions ensure that the amount of fuel will only be adapted if the prerequisites for doing so exist, thus avoiding the situation, for example, where the amount of fuel will be adapted during a warm start.

In order to individually adjust the characteristic curve for the adaptive values as a function of the temperature, a check is carried out during ongoing lambda controlling to determine whether predefined adaptation conditions exist. If they do, an adaptive value will be determined from control parameters of the lambda control and the characteristic curve will be adjusted as a function of the newly determined adaptive value and of the internal combustion engine's measured temperature. The characteristic curve will thereby be adjusted to the internal combustion engine's particular characteristics by applying the newly determined adaptive values. Ageing processes, system-component tolerances, and other specific characteristics of the internal combustion engine will in particular also be registered through this procedure.

According to a preferred embodiment of the method one activation condition is that the internal combustion engine starts cold and idles. It has been established that adaptive values can be determined particularly reliably from the control parameters of the lambda control specifically for the activation condition just cited. This is to practical effect geared to the control parameters' having assumed a stable value. The adaptive value can also be calculated from the control parameters once these have stabilized and/or when the lambda control has operated for longer than a predefined period. It has been established that even a brief period of, say, 10–20 seconds following a cold start and before first drive-off will suffice to reliably determine the adaptive values from the control parameters of the lambda control.

The adaptive value is preferably determined from an integral portion of the lambda control. Pilot controlling can if necessary be corrected using the integral portion, making it particularly suitable for determining the adaptive value prior to the application of lambda controlling.

In a preferred embodiment the characteristic curve is adapted and a comparison made with the adaptive values hitherto taken into account in the characteristic curve. Through suitably selected calculation methods it is ensured that an adaptive value so far removed from the characteristic curve will result directly in a major change to the characteristic curve.

The adaptive value is preferably weighted across the number of combustion cycles occurring since the start. Weighting of this type will take account of the adaptive value's being suitable for cold conditions of an internal combustion engine and of said value's preferably having an increasingly lesser weighting as the number of combustion cycles increases and hence the internal combustion engine heats up.

BRIEF DESCRIPTION OF THE DRAWINGS

The method according to the invention will be explained in more detail below with the aid of a preferred instance.

DETAILED DESCRIPTION OF THE INVENTION

A check is carried out in a first step 10 after the internal combustion engine starts in order to determine whether the activation conditions (A) exist. As an activation condition it is checked whether the internal combustion engine is idling and if a cold start is taking place. The method thus launches in an idling phase following starting while the internal combustion engine is not at its operating temperature. The lambda probes not being operable while the internal combustion engine is in this state, the air/fuel mixture cannot yet be regulated.

An adaptive value is determined from a characteristic curve in an ensuing step 12. The internal combustion engine's temperature is for this purpose measured in step 12 and the corresponding adaptive value read out in the characteristic curve applied across the temperature. The adaptive value indicates how the injected amount of fuel is to be adjusted to the operating temperature. A basic value for an amount of fuel, for example, can be specified for this that is raised or lowered by the adaptive value as a function of the internal combustion engine's operating temperature.

The adaptive value is weighted in step 14 to allow for the fact that the internal combustion engine's temperature increases over time and hence with the combustion cycles. As an instance of weighting it can be provided for the adaptive value initially to be entered having the weighting 1 and after, say, 800 combustion cycles to be rated only having the weighting 0.2.

The amount of fuel is calculated according to the adaptive value in step 16 and injected.

A check is carried out in a second phase of the exemplary embodiment to determine whether the adaptation conditions (B) exist. In the second phase the characteristic curve is adjusted to the internal combustion engine's particular characteristics. As an adaptation condition it is checked whether the internal combustion engine will continue idling on application of lambda controlling. In this case a mixture-adaptation value will be determined from the I portion of the lambda control via a low-pass filtering operation. A check is carried out in step 22 for the adaptive value calculated in step 20 to determine whether this is a new adaptive value, with "new adaptive value" meaning that an adaptive value suitable for adjusting the characteristic curve was calculated at all in step 20. A further check is carried out to determine whether the I portion of the lambda control has already sufficiently stabilized to be able to reliably determine the adaptive value therefrom. If not, the method will be terminated without the characteristic curve's having been adapted.

A new adaptive value possibly determined as being present in step 22 will then be stored in the characteristic curve, with known interpolation or, as the case may be, extrapolation methods preferably being applied to reliably obtain a characteristic curve from the determined adaptive values.

The method according to the invention will terminate at step 26 when the characteristic curve has been adapted.

If the internal combustion engine is restarted at some subsequent time under comparable temperature conditions and if the activation conditions have been met, the previously determined adaptive value will be initiated with the stored value immediately after the transition from start to idling and included in pilot mixture controlling. Weighting across the combustion cycles occurring up to that moment will additionally take place before the adaptive value is converted into an amount of injected fuel. This is because the influence of an imprecise injected amount on mixture deviation does not progress linearly with running time following a cold start. Compensating of mixture deviation taking place in this way will continue being taken into account for as long as the activation conditions are met or until the method changes over to the adaptation phase. It is thus ensured that adapting will also be carried out in response to changing system characteristics over the life of the components and that this will not result in poorer emission values.

If no adaptive values have been previously determined, the initializing value from the family of adaptation characteristics will be used. The adaptive values can likewise be re-initialized for example following a repair or after a component has been replaced. The method according to the invention offers the following advantages:

- lower emissions with the same tolerance requirements placed on the system components,
- more stable emission characteristics as components age,
- avoidance of what is termed the green effect where using a new component results in an abrupt change in system characteristics.

The adaptive values are furthermore also a measure of the effectiveness of the temperature-raising measures performed on the catalytic converter. Significant deviations in the adaptive values can thus also be used to diagnose the cold-start strategy and for raising the temperature of the catalytic converter.

The invention claimed is:

1. A method of controlling an internal combustion engine having a lambda control, the method comprising:

determining if predefined activation conditions are met upon starting the combustion engine by executing a first check procedure;

measuring an internal temperature of the combustion engine and determining an adaptive value using a characteristic curve for calculating a fuel mixture based on the measured internal temperature, if the first check procedure is positive, the characteristic curve including a progression of the adaptive value relative to a progression of the internal temperature;

determining if predefined adaptation conditions are met while the lambda control is in operation by executing a second check procedure; and determining an updated adaptive value using at least one control parameter of the lambda control and adjusting the characteristic curve using the updated adaptive value and the measured internal temperature, if the second check procedure is positive, and maintaining the unadjusted characteristic curve, if the second check procedure is negative, wherein the updated adaptive value is weighted by a weighting parameter during each combustion cycle until the lambda control is in effect.

2. The method according to claim 1, wherein the activation conditions include the conditions that the internal combustion engine has been started at a temperature below a predefined temperature, and that the internal combustion engine is idling.

3. The method according to claim 1, wherein the adaptation conditions include the condition that the internal combustion engine is idling.

4. The method according to claim 1, wherein the adaptive value is calculated using at least one robust control parameter of the lambda control.

5. The method according to claim 4, wherein the robust control parameter is determined from at least one of a plurality of control parameters of the lambda control after a current value of the at least one control parameters has completed transient oscillation.

6. The method according to claim 4, wherein the robust control parameter is determined from at least one of a plurality of control parameters of the lambda control after the lambda control has been operating for at least a predefined minimum operating period.

7. The method according to claims 3, wherein the at least one control parameter of the lambda control is an integral portion included in the lambda control.

8. The method according to claim 4, wherein determining the updated adaptive value is further based on at least one previously updated adaptive value.

9. The method according to claim 2, wherein the weighting parameter is decreased during each combustion cycle following a preceding combustion cycle.

* * * * *